US008313613B2

(12) United States Patent
Matsumura et al.

(10) Patent No.: US 8,313,613 B2
(45) Date of Patent: Nov. 20, 2012

(54) SANITARY THIN PAPER

(75) Inventors: Takashi Matsumura, Fujinomiya (JP); Kiyoshi Taira, Iwakura (JP); Katsuaki Kokubo, Iwakura (JP)

(73) Assignee: Daio Paper Corporation, Tokyo (JP)

( * ) Notice: Subject to any disclaimer, the term of this patent is extended or adjusted under 35 U.S.C. 154(b) by 15 days.

(21) Appl. No.: 12/935,153

(22) PCT Filed: Mar. 31, 2009

(86) PCT No.: PCT/JP2009/056616
§ 371 (c)(1),
(2), (4) Date: Sep. 28, 2010

(87) PCT Pub. No.: WO2009/123175

PCT Pub. Date: Oct. 8, 2009

(65) Prior Publication Data

US 2011/0024066 A1 Feb. 3, 2011

(30) Foreign Application Priority Data

Mar. 31, 2008 (JP) ..... 2008-094220
Jun. 27, 2008 (JP) ..... 2008-169604

(51) Int. Cl.
*D21F 11/00* (2006.01)

(52) U.S. Cl. ..... 162/135; 162/158; 428/153

(58) Field of Classification Search ..... 162/135, 162/158, 175, 109, 111; 428/153
See application file for complete search history.

(56) References Cited

U.S. PATENT DOCUMENTS 6,162,327 A 12/2000 Batra
7,300,544 B2 * 11/2007 Hirasawa ..... 162/135
7,815,769 B2 * 10/2010 Hirasawa ..... 162/135
2008/0038324 A1 2/2008 Itoh

FOREIGN PATENT DOCUMENTS

| | | |
|---|---|---|
| JP | 2003-509598 | 3/2003 |
| JP | 2003-199685 | 7/2003 |
| JP | 2005-113368 | 4/2005 |
| JP | 2007-063695 | 3/2007 |
| JP | 2007-100229 | 4/2007 |
| JP | 2007-203089 | 8/2007 |
| WO | WO2005/117673 A1 | 6/2005 |
| WO | WO2007/034855 | 3/2007 |

OTHER PUBLICATIONS

English translation for WO2007/034855, Mar. 2007.
Japanese translation of CN Office Action dated Feb. 13, 2012 for application CN200980111974.4 citing reference WO2007/034855; 6 pages.

* cited by examiner

*Primary Examiner* — Mark Halpern
(74) *Attorney, Agent, or Firm* — Renner, Kenner, et al.

(57) ABSTRACT

It is a main object to provide sanitary paper comprising:

a base thin paper including 5 to 40 wt % of a treating agent wherein bending rigidity B value is 0.03 to 0.07 g cm2/cm and moisture regain is 4.5 to 6.0 wt %, which are measured at a temperature of 25° C. with a humidity of 40% R.H., and the thin paper includes a fluent liquid state at ordinary temperatures with 70 to 100 wt % of effective ingredient including 1) 80.0 to 97.0 wt % of a moisturizing agent
2) 0.5 to 10.0 wt % of a softening agent selected from anionic surfactants, cationic surfactants, nonionic surfactants, and amphoteric surfactants.
3) 0.001 to 1.0 wt % of a hydrophilic high molecular compound.

8 Claims, 3 Drawing Sheets

Results of sensory evaluation under high-humidity condition (70%)

◇: Example 1 △: Conventional example 1

Results of sensory evaluation under low-humidity condition (40%)

◇: Example 1 △: Conventional example 1

Changes in moisture regain over time

SANITARY THIN PAPER

This application is a 371 of PCT/JP2009/056616 filed on 31 Mar. 2009

This application claims the benefit of International Application Serial No. PCT/JP2009/056616 filed Mar. 31, 2010 which claims priority from Japanese Patent Application Serial No. JP2008-094220, filed Mar. 31, 2008 and Japanese Application Serial No. JP2008-169604, filed Jun. 27, 2008, all of which are incorporated herein by reference.

TECHNICAL FIELD

The present invention relates to sanitary thin paper such as tissue paper, in particular to sanitary thin paper that contains a thin paper treating agent including a moisturizing ingredient.

BACKGROUND ART

Such sanitary thin paper containing a thin paper treating agent including a moisturizing ingredient is well known and called lotion type. This kind of sanitary thin paper is also called lotion tissue but is differentiated from moistened-type wet tissue. This sanitary thin paper is not moistened and thus is treated in the same category as general non-moisturized tissue paper.

This kind of sanitary thin paper has excellent hand feel represented by softness, cashmere-like feel, smoothness, non-scrooping feel, and fullness, and is reduced in irritation to skin, as compared to the general non-moisturized thin paper. Accordingly, this kind of sanitary thin paper is frequently used for blowing a nose and taking facial skin care.

However, the conventional products of this kind of sanitary thin paper may vary in hand feel and physical properties depending on environment, due to the functions of moisture absorption and moisture desorption contributed by the moisturizing ingredient. For example, such conventional products may vary in hand feel depending on region, season and indoor environment of use, and therefore may not provide desired hand feel.

More specifically, the conventional products may deteriorate in moistness under a low-humidity environment and decrease in strength such as tearing strength and tensile strength under a high-humidity environment.

In addition, depending on a usage environment, the conventional tissue paper may discharge water and the boxes of the tissue paper absorb the discharged water with deterioration in strength. This causes the stacked boxes to be deformed and damaged during stacking in storage and the like.

Further, the conventional products need to contain a certain excess amount of thin paper treating agent in the sanitary thin paper so as to provide sufficiently favorable hand feel at a usage site under an ambient atmosphere, particularly, a dry atmosphere. This leads to weakened paper strength of the sanitary thin paper.

Meanwhile, some chemical agents including a gel composition have been suggested as thin paper treating agents. However, it is hard to let such an agent as it is contained uniformly in thin paper. This requires a complicated process of heating and diluting the agent for fluidization, and extends a time necessary for drying a diluted water content. Further, the thin paper with such an agent has problems of weakened paper strength and deteriorated bending rigidity and hand feel, due to uneven application of the agent or advanced dryness of a gel surface of the agent.

Patent Document 1: JP 3950400 B

Patent Document 2: JP 2007-203089 A

DISCLOSURE OF THE INVENTION

Technical Problem to be Solved

Therefore, a main object of the present invention is to provide sanitary thin paper that changes little in hand feel due to humidity and the like.

Means to Solve the Problem

The present invention to solve the foregoing problem, and effects and operations of the same are as follows:

<Invention According to Claim 1>

Sanitary thin paper, containing a thin paper treating agent of 5 to 40 wt %, wherein a bending rigidity B value is 0.03 to 0.07 $g \cdot cm^2/cm$ and a moisture regain is 4.5 to 6.0 wt %, which are measured at a temperature of 25° C. and a humidity of 40% R.H., the thin paper treating agent exhibits a fluent liquid state at ordinary temperatures and contains an effective ingredient of 70 to 100 wt %, the effective ingredient contains a moisturizing agent of 80.0 to 97.0 wt %, a softening agent of 0.5 to 10.0 wt %, and a hydrophilic high molecular compound of 0.001 to 1.0 wt %, and the softening agent is selected from among anionic surfactants, cationic surfactants, nonionic surfactants, and amphoteric surfactants.

<Invention According to Claim 2>

The sanitary thin paper according to Claim 1, wherein a bending rigidity B value measured at a humidity of 70% R.H. and a temperature of 25° C. is 0.02 to 0.04 $g \cdot cm^2/cm$, and a moisture regain is 10.0 to 13.0 wt %, and a difference between a bending rigidity B value measured at a humidity of 40% R.H. and a temperature of 25° C. and the bending rigidity B value measured at a humidity of 70% R.H. and a temperature of 25° C. is 0.03 to 0.01 $g \cdot cm^2/cm$.

<Invention According to Claim 3>

The sanitary thin paper according to Claim 1 or 2, wherein a difference between surface moisture regains measured over time in accordance with the following steps (A) to (C), is 4.5% or less at any of time points after a lapse of 3 hours, a lapse of 5 hours, and a lapse of 22 hours:

(A) leave a specimen under appropriate temperature and humidity conditions until a surface moisture regain of the specimen reaches 12.0%±0.5%;

(B) after the step (A), move the specimen immediately into constant-temperature, constant-humidity environments at a temperature of 25° C. and a humidity of 0% R.H., and measure a surface moisture regain of the specimen over time; and (C) calculate a difference between the surface moisture regain of the specimen measured immediately after the step (A) and the surface moisture regain of the specimen measured at a time point after a lapse of a predetermined time.

Effect of the Invention

According to the present invention as described above, there provided sanitary thin paper that changes little in hand feel due to humidity of an ambient environment and the like.

BEST MODE FOR CARRYING OUT THE INVENTION

An embodiment of the present invention will be described below in detail.

[Structural Example]

The sanitary thin paper of the present invention desirably has a ply structure in which two or more thin paper sheets (hereinafter, referred also to base paper sheets) are layered. The number of layered base paper sheets is not specifically limited and may be changed to two, three, four, or more as appropriate, for example. In particular, the desired number is two or three for suitability for use as tissue paper. However, the present invention is not limited to an embodiment having a layered structure.

[Thin Paper]

Meanwhile, there is no particular limitation to pulp as a raw material for thin paper (base paper sheets) constituting the sanitary thin paper of the present invention. Appropriate raw material pulp can be selected in accordance with the usage of the sanitary thin paper. For example, one or several kinds of pulps can be selected as appropriate from among wood pulp, non-wood pulp, synthetic pulp, recycled pulp, or the like, more specifically, mechanical pulps (MP) such as groundwood pulp (GP), stone groundwood pulp (SGP), refiner groundwood pulp (RGP), pressure groundwood (PGW), thermomechanical pulp (TMP), chemi-thermomechanical pulp (CTMP), and bleached chemi-thermomechanical pulp (BCTMP); kraft pulps (KP) such as a chemi-groundwood pulp (CGP), a semi-chemical pulp (SCP), a Laubholz bleached kraft pulp (LBKP) and a Nadelholz bleached kraft pulp (NBKP); chemical pulps (CP) such as an alkali pulp (AP), a sulfite pulp (SP), and a dissolving pulp (DP); synthetic pulps made from nylon, rayon, polyester, polyvinyl alcohol (PVA), or the like; recycled pulps such as a deinked pulp (DIP) and a waste pulp (WP); trash pulps (TP); rag pulps made from cotton, flax, hemp, jute, Manila hemp, ramie, or the like; culm pulps such as a straw pulp, an esparto pulp, a bagasse pulp, a bamboo pulp, a kenaf pulp, and the like; and auxiliary pulps such as a bast pulp.

In particular, the preferred raw material pulp is a combination of NBKP and LBKP for the purpose of toilet paper or tissue paper. Although a recycled pulp may be added to the two pulps as appropriate, a mixture of only NBKP and LBKP is more preferred in terms of favorable hand feel. In that case, the mixture ratio is NBKP:LBKP=30:70 to 50:50, in particular desirably NBKP:LBKP=40:60.

Raw materials such as pulp fibers are subjected to publicly known paper-making processes, specifically, wire part, press part, dryer part, size press, calender part, and the like, to thereby form a base paper sheet.

In those paper-making processes, appropriate chemical(s) can be added to the paper material, such as a dispersing agent, caustic soda, a pH adjuster such as ammonia water, an antifoaming agent, an antiseptic agent, a fluorescent dye, a release agent, a water resistant additive, a fluidity modifier, a yield enhancer, for example.

[Bending Rigidity]

Meanwhile, the sanitary thin paper of the present invention desirably has a bending rigidity, an index of softness and fullness, of 0.03 to 0.07 $g \cdot cm^2/cm$. The bending rigidity in the present invention is determined in such a manner that: a measurement specimen is prepared by cutting four-folded tissue into a size of 10 cm×10 cm; the specimen is measured in length in longitudinal (warp) and lateral (weft) directions using a KES-FB2-S (manufactured by Kato Tech Co., Ltd.) under the foregoing humidity and temperature conditions; and the measured values are averaged. With a lower bending rigidity, the tissue is rated as being high in softness and fullness.

Further, the sanitary thin paper of the present invention has a difference of 0.03 to 0.01 $g \cdot cm^2/cm$ between the bending rigidity measured at a humidity of 70% R.H. and a temperature of 25° C. and the bending rigidity measured at a humidity of 40% R.H. and a temperature of 25° C., preferably 0.025 to 0.015 $g \cdot cm^2/cm$.

The sanitary thin paper of the present invention is characterized in that there is a small difference in bending rigidity at the foregoing humidities and temperatures, therefore there is an extremely small change in hand feel caused by ambient humidities and temperatures.

[Moisture Regain]

Meanwhile, the sanitary thin paper of the present invention has a moisture regain of 4.5 to 6.0 wt % measured at a humidity of 40% R.H. and a temperature of 25° C.

In addition, the sanitary thin paper of the present invention has a moisture regain of 10.0 to 13.0 wt % measured at a humidity of 70% R.H. and a temperature of 25° C.

Further, it is desired that a difference in moisture regain in the foregoing humidity range is less than 8.0 wt %.

The moisture regain here is measured after a lapse of 24 hours since the measurement specimen is left under measurement environments. The moisture regain is defined as moisture regain (wt %)=[(weight after humidity adjustment)/(weight under absolute dry condition)−1]×100.

In the sanitary thin paper of the present invention, a difference in surface moisture regain over time measured in accordance with the following steps (A) to (C) is 4.5% or less at any of time points after a lapse of 3 hours, a lapse of 5 hours, and a lapse of 22 hours. With a difference of 4.5% or less, the sanitary thin paper is sufficiently and reliably effective in decreasing change in hand feel caused by humidity and the like. In the invention of Claim 1 or 2, this requirement, that is, a change in surface moisture regain difference of 4.5% or less, can be achieved.

(A) Left a specimen for about 24 hours under appropriate temperature and humidity conditions, for example, under constant-temperature, constant-humidity environments at a temperature of 25° C. and a humidity of 50% R.H., such that a surface moisture regain of the specimen reaches 12.0%±0.5%. The surface moisture regain here can be measured using a paper/cardboard moisture meter such as KG-100i produced by Sanko Electronic Laboratory Co., Ltd.

(B) Then, after the step of (A), move the specimen immediately into constant-temperature, constant-humidity environments at a temperature of 25° C. and a humidity of 0% R.H., for example, into a desiccator stored in a constant temperature room, and the foregoing moisture meter is used to measure a surface moisture regain over time. The humidity in the desiccator needs to be checked using a hygrometer placed in the desiccator. The hygrometer may be "ST-4 round-type 4.5 cm" produced by Shinwa Rules Co., Ltd., for example.

(C) Calculate a difference between the surface moisture regain of the specimen measured after the step of (A) and the surface moisture regain of the specimen measured after a lapse of a predetermined time.

[Dry Tensile Strength]

Meanwhile, the sanitary thin paper of the present invention desirably has a dry tensile strength of 120 to 350 cN/25 mm in a longitudinal direction, more desirably 140 to 310 cN/25 mm.

The dry tensile strength of the present invention is measured using the "Universal Compression and Tensile Testing Machine TG-200N" produced by Minebea Co., Ltd.

A dry tensile strength of less than 120 cN/25 mm causes paper breakage during paper sheet production. In contrast, a dry tensile strength of more than 350 cN/mm deteriorates paper hand feel represented by softness.

The dry tensile strength can be adjusted as appropriate by adding a dry paper strength enhancer to the paper materials or by regulating a crepe ratio at manufacture of the base paper sheets. The crepe ratio is expressed as (((peripheral speed of a dryer at paper manufacturing)−(peripheral speed of a reel))/(peripheral speed of the dryer at paper manufacturing)×100).

[Thin Paper Treating Agent]

Meanwhile, the sanitary thin paper of the present invention contains a thin paper treating agent of a predetermined composition described later of 5 to 40 wt %. If the sanitary thin paper is formed by layering a plurality of thin paper sheets, at least one of the constitutional thin paper sheets, either upper or lower one, contains a thin paper treating agent of 5 to 40 wt %.

A content of a thin paper treating agent of less than 5 wt % brings about an insufficient effect of improving hand feel represented by smoothness on the paper surface. In contrast, a content of a thin paper treating agent of more than 40 wt % causes paper breakage due to lowered strength.

Meanwhile, a characteristic thin paper treating agent of the present invention contains an effective ingredient described later of 70 to 100 wt %. With an effective ingredient of less than 70%, the thin paper treating agent cannot bring about a sufficient effect. Here, an ingredient other than the effective ingredient is water.

In the present invention, the effective ingredient includes a moisturizing agent, a softening agent, and a hydrophilic high molecular compound. The proportions of the effective ingredient are 80.0 to 97.0 wt % for the moisturizing agent, 0.5 to 10.0 wt % for the softening agent, and 0.001 to 1.0 wt % for the hydrophilic high molecular compound.

The softening agent can be selected as appropriate from among anionic surfactants, nonionic surfactants, cationic surfactants, and amphoteric surfactants, and particularly preferred are anionic surfactants. The anionic surfactants may be based on any of carboxylic acid salt, sulphonic acid salt, sulfate salt, phosphate salt, and the like, and preferred anionic surfactants are based on alkyl phosphate salt. In addition, the moisturizing agent may be any combination of one or more of polyhydric alcohols such as glycerin, diglycerol, propylene glycol, and 1,3-butylene glycol; saccharides such as sorbitol, glucose, xylitol, maltose, maltitol, mannitol, and trehalose; glycol-based chemical agents and derivatives thereof; higher alcohols such as cetanol, stearyl alcohol, and oleyl alcohol; liquid paraffin; collagen; hydrolyzed collagen; hydrolyzed keratin; hydrolyzed silk, and ceramide. Using those substances enhances the thin paper in flexibility and moisture retention.

Further, the hydrophilic high molecular compound in the present invention constitutes a high molecular compounds that dissolves, disperses, or swells in hot water or cool water. The hydrophilic high molecular compound may be any of natural polymers based on animals, plants, microorganisms, polysaccharides, and the like; semisynthetic polymers such as starch derivatives (soluble starch, carboxylated starch, British rubber, dialdehyde starch, dextrin, cationic starch, and the like), cellulose derivatives (viscose, methyl cellulose, ethyl cellulose, carboxymethyl cellulose, hydroxyethyl cellulose, and the like); and synthetic polymers such as (meth) acrylamide polymer, N-substituted (meth)acrylamide polymer, N-vinyl(methyl)amide polymer, (meth)acryl acid (salt) polymer, (meth)acrylic acid ester polymer, polyvinyl alcohol, polyvinylamine, polyethylene oxide, polyethyleneimine, polyvinylpyridine, polyallylamine. Particularly, from the viewpoint of environmental hygiene, natural polymers are preferable for a superior level of safety even in direct contact with a human body and ease of disposal with excellent spontaneous decomposition property, and among the same, water-soluble polysaccharides are more preferable. The water-soluble polysaccharides include water-soluble neutral polysaccharides such as gum arabic, xanthane gum, gellan gum, indigestible dextrin, guar gum, partially hydrolyzed guar gum, pullulan, water-soluble corn fiber, hemicellulose, low molecular hemicellulose, locust bean gum, konjac mannan, curdlan, and polydextrose; water-soluble acid polysaccharides such as low molecular alginic acid, carrageenan, agar, pectin, fucoidin, porphyran, agaropectin, karaya gum, gellan gum, and xanthane gum; and water-soluble basic polysaccharides such as chitosan, polygalactosamine, water-soluble chitin. In particular, water-soluble neutral polysaccharides are preferred because those neutral polysaccharides have no acid group or basic group in molecules, and raise no possibilities of causing odors, hue change, lowered water solubility depending on pH, or formation and deposition of ionic substances and complexes. These hydrophilic high molecular compounds can be used singly or in combination of two or more. The hydrophilic high molecular compound absorbs and retains water several tens to several hundreds of times heavier than the compound's own weight. This makes it possible to suppress a change in moisture contained in paper to be processed due to humidity environments and reduce changes in hand feel of the thin paper.

If the hydrophilic high molecular compound is less than 0.001%, there is a possibility that the thin paper becomes less effective in maintaining hand feel against changes in humidity environments. In contrast, if the hydrophilic high molecular compound exceeds 1.0 wt %, there is a possibility that the thin paper becomes hard and loses flexibility, which leads to deteriorated hand feel.

It is important that the thin paper treating agent is prepared so as not to turn into a gel. If gelating and losing fluidity, the treating agent is lowered in ease of handling at storage and transport. This requires a heating process for liquefying the treating agent at the time of application to the thin paper, which is uneconomical and inefficient. Further, the thin paper to which the treating agent is applied exhibits harsh feel due to uneven application of the agent or advanced dryness of a gel surface of the agent, thereby giving deteriorated hand feel. Accordingly, for prevention of the treating agent from turning into a gel, an enzyme is used to decompose an appropriate amount of high molecular compound with a high degree of cross-linkage which is prone to gelate, and then the enzyme is deactivated to get the hydrophilic high molecular compound with the capability of water retention, whereby a flowing liquid material can be obtained. Alternatively, appropriate amounts of low molecular weight saccharides are mixed into the foregoing decomposed material for enhancement of water retention capability, whereby a flowing liquid material can be obtained. In addition, some kinds of hydrophilic high molecular compounds may gelate due to the existence of acids, alkalis, specific ions, or saccharides, or other hydrophilic high molecular compounds, or may cause a behavior change including gelation as a hysteresis phenomenon due to the course of heating processes. Therefore, for obtaining a flowing liquid material, it is necessary to comprehend the characteristics of the selected hydrophilic high molecular compound and adjust other ingredients as appropriate in proportion and additive amount.

Meanwhile, the thin paper treating agent of the present invention can be contained in the thin paper by any of appropriate application and coating methods using known coaters, printing presses, and spray applicators. In particular, since the thin paper treating agent of the present invention may have a viscosity of 100 to 500 mPa·sec, an application and coating method through high-speed online printing is suitable, in particular an application and coating method through online gravure printing is preferable.

In the case of using an application and coating method through online gravure printing, a desired application quantity is 12 to 20 g/m$^2$.

[Basis Weight]

Meanwhile, a basis weight of the sanitary thin paper of the present invention can be adjusted as appropriate depending on the intended use. In general, a favorable basis weight of the same is 20 to 80 g/m$^2$, preferably 26 to 40 g/m$^2$. In the case of a layered structure, a basis weight of each layer is 10 to 40 g/m$^2$, preferably 12 to 20 g/m$^2$. A basis weight of less than 10 g/m$^2$ is preferable from the viewpoint of improving the paper in softness but makes it difficult to provide a sufficient strength properly for practical use. In contrast, a basis weight of more than 40 g/m$^2$ makes the sanitary thin paper too hard with deteriorated hand feel. This range of basis weight is suitable in particular for the case where the sanitary thin paper is used as tissue paper. A basis weight here is measured by the JIS P 8124 measurement method.

[Paper Thickness]

A paper thickness can also be adjusted as appropriate depending on the intended usage. In the case of tissue paper, a preferable paper thickness is 60 to 250 μm. A paper thickness of less than 60 μm is preferable from the viewpoint of improving the paper in softness but makes it difficult to properly provide a strength required for tissue paper. In contrast, a paper thickness of more than 250 μm causes the tissue paper to deteriorate in hand feel and cause a rough feel to a user. In the case of a layered structure, there is no need to unify all the thicknesses of base paper sheets constituting the layers.

A paper thickness is measured under JIS P 8111 conditions using the dial thickness gauge (thickness measuring instrument) "PEACOCK G Type" (produced by Ozaki MFG. Co., Ltd.). Specifically, the thickness measurement is carried out in accordance with the following procedure: make sure there is no foreign matter or dust between a plunger and a measurement stand; lower the plunger onto the measurement stand; move and adjust a scale of the dial thickness gauge to a zero point; lift up the plunger and place a specimen (for example, toilet paper) on the measurement stand; and lower the plunger slowly and read the gauge at that time. In the measurement, the plunger is just put on the specimen. The value of paper thickness here is determined by obtaining readings ten times and averaging the ten measurement results.

A tensile strength of the sanitary thin paper of the present invention is measured in conformance with the JIS P 8113 tensile testing method. In the measurement, the sanitary thin paper is cut out into a size 25 mm long and 25 mm wide under the standard conditions defined by JIS P 8111.

[Ply Peel Strength]

In the case of a layered structure, each of the base paper sheets preferably has a ply peel strength of 5 to 100 cN/50 mm. With a ply peel strength of less than 5 cN/50 mm, the base paper sheets may be stuck together insufficiently and be separated unintentionally. In contrast, with a ply peel strength of more than 100 cN/50 mm, the sanitary thin paper becomes too hard with deteriorated hand feel. A ply peel strength is measured in conformance with the JIS P 8113 tensile testing method. In the measurement, a specimen is longitudinally cut out in a size 50 mm wide under the standard conditions defined by JIS P 8111. After the cutting, the specimen is longitudinally separated. One separated part of the specimen is fixed to an upper grab tool of a peeling tester load cell (TG200N produced by Minebea Co., Ltd.) and the other separated part is fixed to a lower grab tool of the same, with a spacing of 8 cm left between the two parts. Then, the parts are vertically pulled at a rate of 100 mm/minute, and are further separated 5 cm and measured in strength at the time.

EXAMPLES

Examples of the present invention and conventional examples will be described below to ascertain the advantages of the present invention. Thin paper treating agents and specimens used for the examples, the conventional examples, and comparative examples will be described below.

<Thin Paper Treating Agent>

The thin paper treating agent used for examples 1 and 2 is a liquid material with a viscosity of 230 mPa·sec (25° C.), containing a moisturizing agent (glycerin) of 83.0 wt %, a softening agent (alkyl phosphate salt) of 1.9 wt %, a hydrophilic high molecular compound (water-soluble neutral polysaccharide) of 0.1 wt %, and water of 15.0 wt %.

The thin paper treating agent used for conventional examples 1 and 2 is a liquid material with a viscosity of 210 mPa·sec (25° C.), containing a moisturizing agent (glycerin) of 88.1 wt %, a softening agent (alkyl phosphate salt) of 1.9 wt %, and water of 10.0 wt %.

The specimen used for comparative examples 1 to 4 is commercially offered lotion tissue.

Example 1, conventional example 1, and comparative examples 1 to 4 were tested for relationships between ambient environments, hand feel, and bending rigidity. The test results will be described below.

<Test 1: Sensory Evaluation>

Sensory evaluation was carried out on the specimen of the present invention (example 1) and the conventional product (conventional example 1) under a high humidity environment (at a humidity of about 70% R.H.) and a low humidity environment (at a humidity of about 40% R.H.).

The example of the present invention has a content of thin paper treating agent of 20 wt %, and conventional example 1 has a content of thin paper treating agent of 23 wt %, as shown in Table 1.

FIGS. 1 and 2 show the evaluation results.

The sensory evaluation was performed in the check categories "moistness," "softness," "cashmere-like feel," "smoothness," "non-scrooping feel," and "fullness." In this evaluation, the example of the present invention was comparatively evaluated on a scale of 1 to 5, with reference to the conventional example with 3. The numbers in the drawing show averages of ratings given by 100 testers.

As seen from FIGS. 1 and 2, the example of the present invention is more highly rated in the sensory evaluation than conventional example 1, under both the high-humidity environment and the low-humidity environment. Accordingly, it can be understood that the examples of the present invention are excellent in hand feel regardless of ambient environments.

<Test 2: Bending Rigidity>

The specimen of the present invention (example 1), conventional example 1, comparative examples 1 to 4 were measured in bending rigidity under an environment at a temperature of 25° C. and a humidity of 40% R.H. and under an environment at a temperature of 25° C. and a humidity of 70% R.H., and were evaluated for differences therebetween. In addition, the foregoing examples were also measured in moisture regain.

The bending rigidity measurement was carried out using KES-FB2-S (produced by Kato Tech Co., Ltd.).

The specimens each have a size of 10 cm×10 cm. Table 1 shows the test results.

TABLE 1

| | | Example 1 | Conventional example 1 | Comparative example 1 | Comparative example 2 | Comparative example 3 | Comparative example 4 |
|---|---|---|---|---|---|---|---|
| Content of thin paper treating agent (wt %) | | 19.6 | 23.4 | 23.0 | 19.1 | 12.7 | 17.6 |
| Bending rigidity ($g \cdot cm^2/cm$) | 40% R.H. | 0.058 | 0.071 | 0.071 | 0.075 | 0.076 | 0.075 |
| | 70% R.H. | 0.035 | 0.034 | 0.045 | 0.048 | 0.038 | 0.037 |
| Difference in bending rigidity | | 0.023 | 0.037 | 0.026 | 0.026 | 0.037 | 0.038 |
| Moisture regain (wt %) | 40% R.H. | 4.9 | 4.8 | 4.4 | 4.2 | 4.2 | 4.0 |
| | 70% R.H. | 11.8 | 11.5 | 10.9 | 10.1 | 9.9 | 9.6 |

As shown in Table 1, example 1 of the present invention has significantly small differences in bending rigidity from conventional example 1 and comparative examples 1 to 4, under the 40% R.H. environment and the 70% R.H. environment. In particular, example 1 of the present invention is recognized as excellent in softness under the low-humidity environment.

The foregoing tests 1 and 2 have revealed that the present invention is excellent in hand feel under both the low-humidity environment and the high humidity environment, and also the present invention changes little in softness even with variations in ambient humidity.

Therefore, according to the present invention, it is possible to provide sanitary thin paper that is sufficiently improved in hand feel represented by flexibility and the like regardless of environments, and changes little in hand feel due to variations in ambient humidity.

Example 2, conventional example 2, and comparative example 5 were tested for checking how differences in surface moisture regain vary over time. Comparative example 5 is identical to the specimen used for comparative example 1.

In the measurement, the specimens of the foregoing examples were left stand for 24 hours under a constant temperature and constant humidity environment at a temperature of 25° C. and a humidity of 50% R.H., thereby adjusting the surface moisture regains of the specimens as shown in Table 2. The measurement of surface moisture regain was carried out using the paper/cardboard moisture meter KG-100i produced by Sanko Electronic Laboratory Co., Ltd.

Then, after the measurement of surface moisture regain, the specimens were immediately moved into a desiccator (at an internal humidity of 0% R.H.) stored in a constant temperature room at a temperature of 25° C., and then were measured in surface moisture regain over time using the foregoing moisture meter. The measurement results are as shown in Table 2 and FIG. 3 (graph). In the graph of FIG. 3, the vertical axis indicates surface moisture regain (%), the horizontal axis indicates time (minute).

TABLE 2

| Elapsed time (min) | Example 2 (%) | Conventional example 2 (%) | Comparative example 5 (%) |
|---|---|---|---|
| 0 | 11.9 | 11.8 | 11.8 |
| 30 | 11.3 | 10.6 | 10.4 |
| 60 | 10.3 | 9.2 | 9.1 |
| 90 | 9.7 | 8.7 | 8.5 |
| 120 | 9.5 | 8.3 | 8.2 |
| 150 | 9.2 | 8.1 | 8.1 |
| 180 | 9.1 | 7.9 | 7.6 |
| 210 | 9.0 | 7.8 | 7.5 |
| 240 | 9.0 | 7.7 | 7.4 |

TABLE 2-continued

| Elapsed time (min) | Example 2 (%) | Conventional example 2 (%) | Comparative example 5 (%) |
|---|---|---|---|
| 270 | 8.9 | 7.6 | 7.4 |
| 300 | 8.8 | 7.5 | 7.2 |
| 330 | 8.7 | 7.5 | 7.1 |
| 1320 | 7.4 | 5.9 | 5.6 |

As seen from the foregoing results, example 2 of the present invention decreased in surface moisture regain by 4.5% or less for a lapse of 22 hours. On the other hand, conventional example 2 and comparative example 5 decreased more significantly in surface moisture regain and therefore are considered as inferior in water retention capability.

Therefore, it can be said that the sanitary thin paper of the present invention is excellent in water retention capability as a factor influential on hand feel change over time.

INDUSTRIAL APPLICABILITY

The sanitary thin paper of the present invention is applicable to tissue paper used for cleansing, in particular body cleansing, and for facial skin care.

Figure 1:
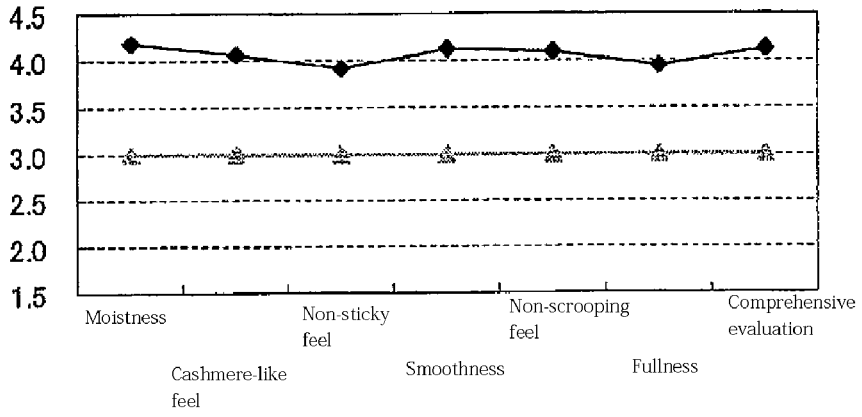
FIG. 1 is a graph showing results of sensory evaluation on the example of the present invention, the conventional example, and the comparative examples, under a high-humidity environment.
Figure 2:
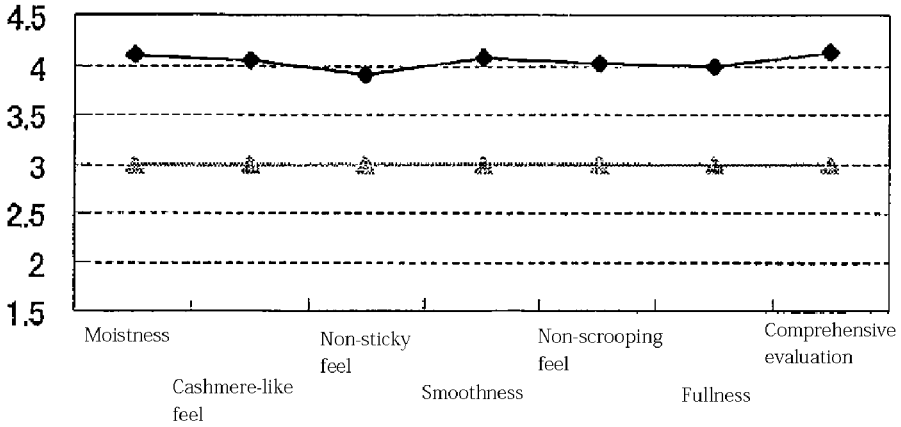
FIG. 2 is a graph showing results of sensory evaluation on the example of the present invention, the conventional example, and the comparative examples, under a low-humidity environment.
Figure 3:
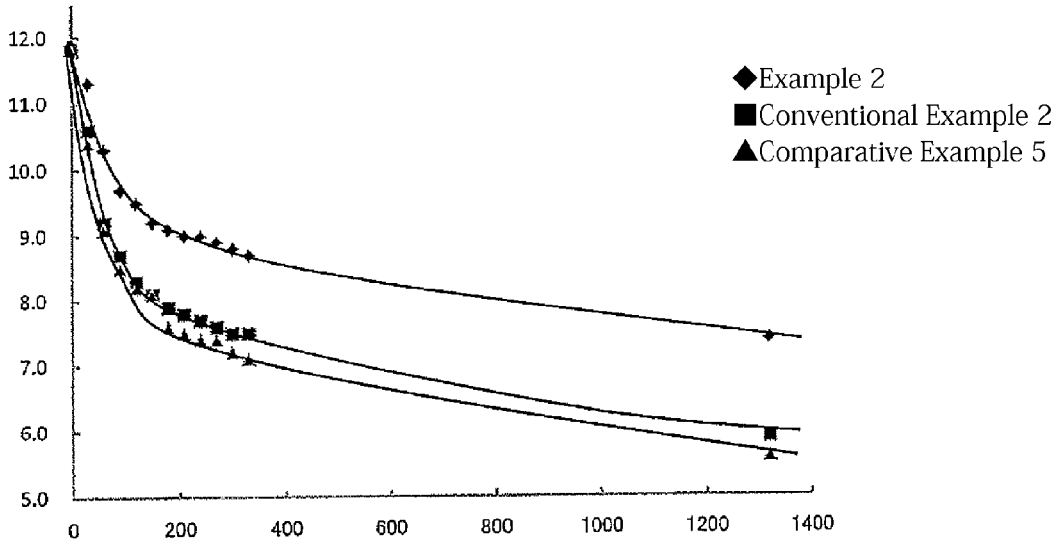
FIG. 3 is a graph showing results of testing on the example of the present invention, the conventional example, and the comparative example, for changes in surface moisture regain over time.

The invention claimed is:

1. A sanitary thin paper comprising:

a base paper including 5 to 40 wt % of a treating agent, wherein the sanitary paper has a bending rigidity B value is 0.03 to 0.07 g·cm$^2$/cm and a moisture regain is 4.5 to 6.0 wt %, which are measured at a temperature of 25° C. and a humidity of 40% R.H., the thin paper treating agent exhibits a fluent liquid state at ordinary temperatures and contains an effective ingredient of 70 to 100 wt %, the treating agent including 80.0 to 97.0 wt % of a moisturizing agent, 0.5 to 10.0 wt % of a softening agent, and 0.001 to 1.0 wt % of a hydrophilic high molecular compound, and where the softening agent is selected from among anionic surfactants, cationic surfactants, nonionic surfactants, and amphoteric surfactants.

2. The sanitary thin paper according to claim 1, wherein the sanitary paper has a bending rigidity B value measured at a humidity of 70% R.H. and a temperature of 25° C. is 0.02 to 0.04 g·cm$^2$/cm, and a moisture regain is 10.0 to 13.0 wt %, and a difference between a bending rigidity B value measured at a humidity of 40% R.H. and a temperature of 25° C. and a bending rigidity B value measured at a humidity of 70% R.H. and a temperature of 25° C. is 0.03 to 0.01 g·cm$^2$/cm.

3. The sanitary thin paper according to claim 1, wherein a difference between surface moisture regains measured over time in accordance with the following steps (A) to (C), is 4.5% or less after a lapse of 22 hours:

(A) leave a specimen under appropriate temperature and humidity conditions until a surface moisture regain of the specimen reaches 12.0%±0.5%;

(B) after the step (A), move the specimen immediately into constant-temperature, constant-humidity environments at a temperature of 25° C. and a humidity of 0% R.H., and measure a surface moisture regain of the specimen over time; and (C) calculate a difference between the surface moisture regain of the specimen measured immediately after the step (A) and the surface moisture regain of the specimen measured at a time point after a lapse of a predetermined time.

4. The sanitary thin paper according to claim 1, wherein the sanitary paper has a bending rigidity B value measured at a humidity of 70% R.H. and a temperature of 25° C. is 0.02 to 0.04 g·cm$^2$/cm, and a moisture regain is 10.0 to 13.0 wt %, and a difference between a bending rigidity B value measured at a humidity of 40% R.H. and a temperature of 25° C. and a bending rigidity B value measured at a humidity of 70% R.H. and a temperature of 25° C. is 0.03 to 0.01 g·cm$^2$/cm; and wherein a difference between surface moisture regains measured over time in accordance with the following steps (A) to (C), is 4.5% or less after a lapse of 22 hours:

(A) leave a specimen under appropriate temperature and humidity conditions until a surface moisture regain of the specimen reaches 12.0%±0.5%;

(B) after the step (A), move the specimen immediately into constant-temperature, constant-humidity environments at a temperature of 25° C. and a humidity of 0% R.H., and measure a surface moisture regain of the specimen over time; and (C) calculate a difference between the surface moisture regain of the specimen measured immediately after the step (A) and the surface moisture regain of the specimen measured at a time point after a lapse of a predetermined time.

5. A sanitary paper comprising:

two or more base paper sheets; and a treating agent deposited on at least one of said sheets, where the amount of treating agent deposited on the at least one sheet is 5 to 40 wt. % of the sanitary paper; wherein the treating agent includes from 80.0 to 97.0 wt. % of a moisturizing agent, from 0.5 to 10.0 wt. % of a softening agent, and from 0.001 to 1.0 wt. % of a hydrophilic high molecular weight compound, wherein the softening agent is selected from the group consisting of anionic surfactants, cationic surfactants, non-ionic surfactants, and amphoteric surfactants, and wherein the sanitary paper has a bending rigidity B value of 0.03 to 0.7 g·cm$^2$/cm and a moister regain of 4.5 to 6.0 wt. %, with the bending rigidity and moisture regain being measured at 25° C. and a relative humidity of 40%.

6. The sanitary paper according to claim 5, wherein the sanitary paper has a bending rigidity B value of 0.02 to 0.04 g·cm$^2$/cm and a moisture regain of 10.0 to 13.0 wt. % measured at 25° C. and 70% relative humidity, and where the difference between the bending rigidity B value measured at 40% relative humidity and 25° C. and the bending rigidity B value measured at 70% relative humidity at 25° C. is from 0.03 to 0.01 g·cm$^2$/cm.

7. The sanitary paper according to claim 5, where the difference between the surface moisture regain measured over time in accordance with the steps (A) to (C) is 4.5% or less after a lapse of 3 hours, wherein the surface moisture regain is measured by:

(A) leave a specimen under appropriate temperature and humidity conditions until a surface moisture regain of the specimen reaches 12.0%±0.5%;

(B) after the step (A), move the specimen immediately into constant-temperature, constant-humidity environments at a temperature of 25° C. and a humidity of 0% R.H., and measure a surface moisture regain of the specimen over time; and (C) calculate a difference between the surface moisture regain of the specimen measured immediately after the step (A) and the surface moisture regain of the specimen measured at a time point after a lapse of a predetermined time.

8. The sanitary paper of claim 7, wherein the sanitary paper has a bending rigidity B value measured at a humidity of 70% R.H. and a temperature of 25° C. is 0.02 to 0.04 g·cm$^2$/cm, and a moisture regain is 10.0 to 13.0 wt %, and a difference between a bending rigidity B value measured at a humidity of 40% R.H. and a temperature of 25° C. and a bending rigidity B value measured at a humidity of 70% R.H. and a temperature of 25° C. is 0.03 to 0.01 g·cm$^2$/cm; and wherein a difference between surface moisture regains measured over time in accordance with the following steps (A) to (C), is 4.5% or less after a lapse of 3 hours:

(A) leave a specimen under appropriate temperature and humidity conditions until a surface moisture regain of the specimen reaches 12.0%±0.5%;

(B) after the step (A), move the specimen immediately into constant-temperature, constant-humidity environments at a temperature of 25° C. and a humidity of 0% R.H., and measure a surface moisture regain of the specimen over time; and (C) calculate a difference between the surface moisture regain of the specimen measured immediately after the step (A) and the surface moisture regain of the specimen measured at a time point after a lapse of a predetermined time.

* * * * *

UNITED STATES PATENT AND TRADEMARK OFFICE

CERTIFICATE OF CORRECTION

PATENT NO. : 8,313,613 B2
APPLICATION NO. : 12/935153
DATED : November 20, 2012
INVENTOR(S) : Takashi Matsumura, Kiyoshi Yaira and Katsuaki Kokubo It is certified that error appears in the above-identified patent and that said Letters Patent is hereby corrected as shown below:

Title Page Assignees should read

--(73) Assignee: Daio Paper Corporation, Tokyo (JP)
Miyoshi Oil & Fat Co., Ltd., Tokyo (JP)--

Signed and Sealed this
Thirtieth Day of June, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,313,613 B2
APPLICATION NO. : 12/935153
DATED : November 20, 2012
INVENTOR(S) : Matsumura et al.

It is certified that error appears in the above-identified patent and that said Letters Patent is hereby corrected as shown below:

-- The certificate which issued on June 30, 2015 is vacated because petition to correct assignee under 3.81(b) was not granted by the Office of Petitions. The Certificate of Correction which issued on June 30, 2015 was published in error and should not have been issued for this patent. The assignee is reinstated on the title page of patent at Item (73) as --Daio Paper Corporation, Tokyo (JP)--.

Signed and Sealed this
Fourth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,313,613 B2
APPLICATION NO. : 12/935153
DATED : November 20, 2012
INVENTOR(S) : Takashi Matsumura, Kiyoshi Yaira and Katsuaki Kokubo It is certified that error appears in the above-identified patent and that said Letters Patent is hereby corrected as shown below:

Title page

Item (73) Assignee: Should read as follows,

-- (73) Assignee: Daio Paper Corporation, Tokyo (JP)
Miyoshi Oil & Fat Co., Ltd., Tokyo (JP) --.

Signed and Sealed this
Eighth Day of March, 2016

Michelle K. Lee

Michelle K. Lee
*Director of the United States Patent and Trademark Office*